United States Patent [19]

Swift

[11] Patent Number: 4,664,432

[45] Date of Patent: May 12, 1987

[54] SECURITY SEAL AND SEAL ASSEMBLY

[76] Inventor: Allan W. Swift, 22 Edgewater Dr., Denville, N.J. 07834

[21] Appl. No.: 867,413

[22] Filed: May 15, 1986

Related U.S. Application Data

[63] Continuation of Ser. No. 575,470, Jan. 30, 1984, abandoned.

[51] Int. Cl.[4] ..... E05C 13/02; B65D 55/06

[52] U.S. Cl. ..... 292/282; 24/704; 292/307 A; 292/318; 292/319; 292/322; 292/328

[58] Field of Search ..... 24/16 PB, 16 R, 30.5 P, 24/30.5 R, 704, 161; 292/318–322, 307 A, 307 R, 328, 329, 282

[56] References Cited

U.S. PATENT DOCUMENTS

| | | | |
|---|---|---|---|
| 994,103 | 5/1911 | Davis | 292/319 |
| 1,149,461 | 8/1915 | O'Connor et al. | 292/322 |
| 2,645,514 | 7/1953 | Mitchko | 24/30.5 P X |
| 2,969,570 | 1/1961 | Petri et al. | 24/704 X |
| 3,128,114 | 4/1964 | Nierhaus | 292/320 |
| 3,717,369 | 2/1973 | Sioffel et al. | 292/322 X |
| 3,830,538 | 8/1974 | Moberg | 292/322 |
| 4,229,031 | 10/1980 | Guiler | 292/322 |
| 4,466,160 | 8/1984 | DeLima Castro Netto | 24/30.5 R |
| 4,562,047 | 12/1985 | Sestak et al. | 292/322 X |

FOREIGN PATENT DOCUMENTS

| | | | |
|---|---|---|---|
| 1399004 | 6/1975 | United Kingdom | 24/30.5 L |

*Primary Examiner*—Alfred C. Perham

*Attorney, Agent, or Firm*—Carella, Byrne, Bain & Gilfillan

[57] ABSTRACT

Single piece injection molded security seal includes a flexible strap having fastener support bodies at each end defining a telescoping locking means and having a camming surface for cooperating with the hasp to hold the security seal in descrete positions.

8 Claims, 6 Drawing Figures

SECURITY SEAL AND SEAL ASSEMBLY

This application is a continuation of application Ser. No. 575,470 filed Jan. 30, 1984, now abandoned.

BACKGROUND OF THE INVENTION

In the use of security seals to seal a closure of the type having a staple which extends through a slot in a closure member, it is often desirable that an integral tag be provided on the seal to receive identification markings. In such instances it is important that the tag be maintained in a position such that the identifying numbers or letters thereon can be easily read when the seal is installed or removed. The structure of such seal must also be such that it can be economically manufactured by injection molding techniques, without the molding dies requiring complicated and expensive features.

SUMMARY OF THE INVENTION

This invention provides a security seal for use with a closure member having a staple extending through a slot in a portion of the closure member, and is formed of a single piece of injection molded plastic.

In a preferred embodiment of the invention the seal comprises a locking portion comprising a pair of fastener members connected by a flexible hinge portion, and a tag portion attached to the fastener portions. In the as molded condition, the fastener portions are joined by a flat strap portion which contains the hinge portion, with the fastener portions extending generally perpendicular to the plane of the strap, with the female fastener portion extending in one direction and the male fastener portion extending in the opposite direction. The tag portion is attached to the strap by a flexible member, and in the as molded condition, is co-planar with the flat strap portion.

In one embodiment of the invention the tag is attached to the flat strap portion by a pair of flexible members, which are attached to the strap on opposite sides of the hinge, whereby when the fastener portions are folded together about the hinge for engagement, the tag portion maintains an orientation such that its plane will be parallel to the plane of the surface of the container on which the staple is mounted. The flexible members, in being attached to opposite sides of the hinge, also tend to provide an opening force to the seal, so that the seal will spring open if the stud is not securely engaged in the socket.

DESCRIPTION OF THE ILLUSTRATED EMBODIMENT

Figure 1:
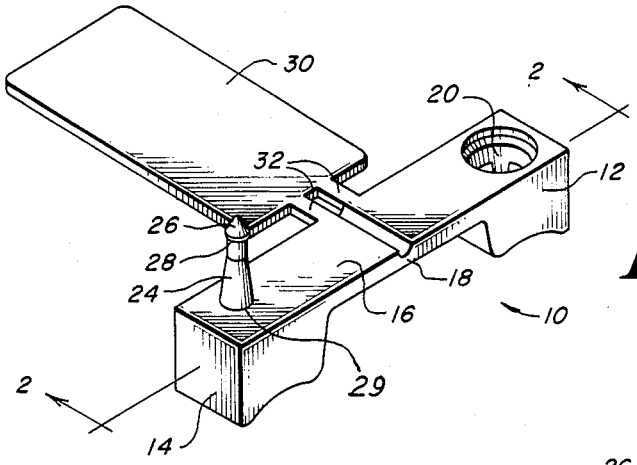
FIG. 1 is a perspective view of a security seal embodying the features of the invention.

Referring to the drawing, there is illustrated a security seal 10, which is preferably formed of injection molded plastic, and comprises a pair of spaced fastener support bodies 12 and 14 which are joined by a flat strap 16 which has a section of reduced thickness at the medial portion forming a hinge 18.

The fastener support member 12 extends from the plane of the strap and has an aperture 20 having a series of resilient fingers 22 disposed about the aperture, said fingers 22 being inclined inwardly and rearwardly to form a locking socket.

The fastener support member 14 also extends fom the plane of the strap, and has a fastener stud 24 extending therefrom in a direction perpendicular to the plane of the strap. The stud has an enlarged head 26 with an abrupt shoulder 28 for locking behind the ends of the fingers 22 in the usual manner when the stud is inserted into the socket.

In a preferred embodiment of the invention the stud is provided with a weakened portion 29 at or near the junction with the support body 14, in the manner disclosed and claimed in my co-pending application Ser. No. 461,731 filed Jan. 31, 1983, now U.S. Pat. No. 4,441,233. The axial dimensions of the stud and the socket also conform to the requirements set out in said application, in which the distance from the top of the fastener support body to the shoulder 28 is the same, (with allowance for manufacturing tolerances) as the distance from the top of the fastener support body 12 to the ends of the fingers 22.

Therefore, as described in said application, if the stud is broken to open the seal, the seal cannot be re-assembled by fusing the stud back onto the support member, since such fusing shortens the stud an amount such that when it is thereafter inserted into the socket, it is not long enough to allow the shoulder 28 to reach the ends of the fingers 22.

The seal 10 also comprises a tag 30 which is attached to the flat strap 16 at the medial portion by a pair of flexible members 32. In the illustrated embodiment, the flexible members are attached to the strap on opposite sides of the hinge 18 for a purpose to appear hereinafter.

Figure 4:
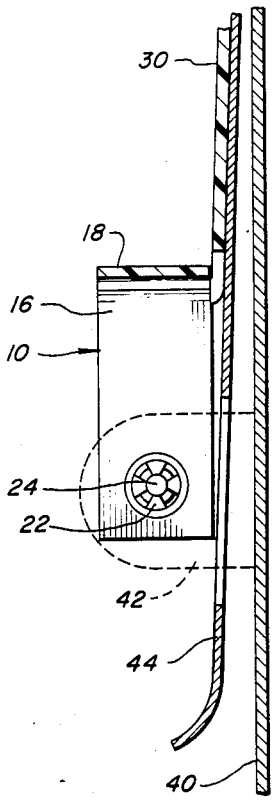
FIG. 4 is a view in section on line 4—4 of FIG. 3.
Figure 5:
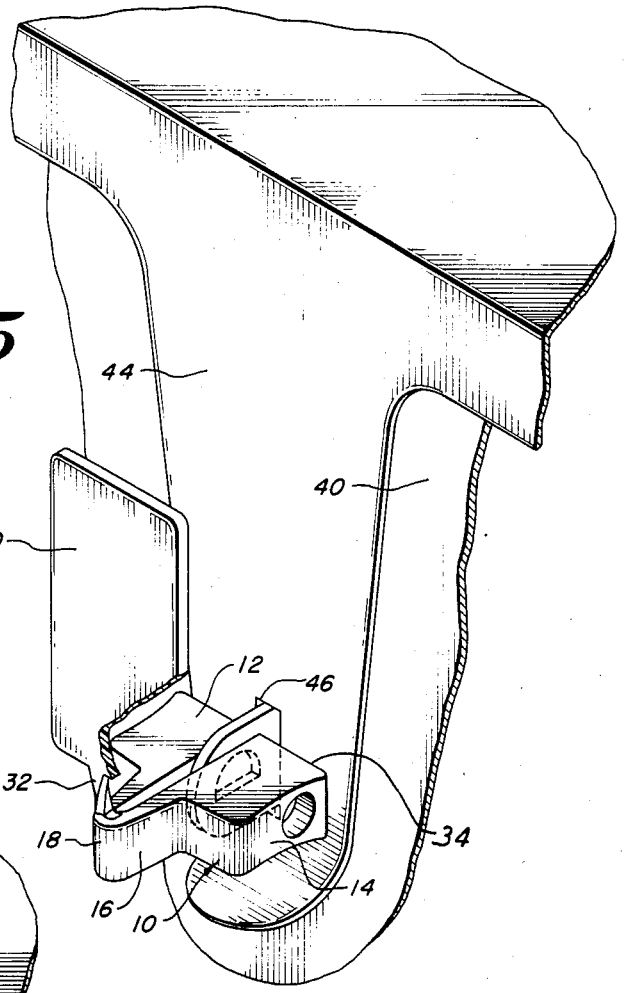
FIG. 5 is a perspective view of the seal and the container in which the seal has been assembled with the closure member of the container into an initial position.
Figure 6:
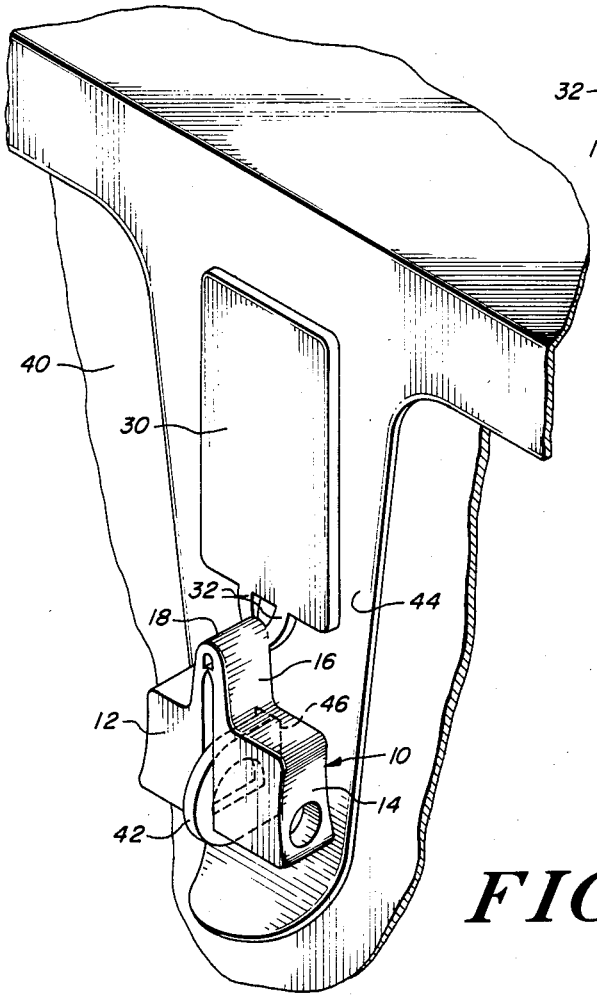
FIG. 6 is a perspective view of the assembly of FIG. 3, in which the seal has been moved from the initial position of FIG. 5 to a final position.

The seal is particularly adapted for sealing a container 40 such as a telephone coin box, which has a staple 42 in one surface thereof and a hasp 44 attached to the box cover and having a slot 46 positioned to receive the staple when the cover is closed, as illustrated in FIGS. 5 & 6. In many such containers, when the cover is closed, the hasp 44 does not lie flat against the box, but is inclined outwardly at a slight angle to the front surface of the box. (See FIG. 4.) This fact will be utilized in the assembly of the seal in a manner to appear hereinafter.

Figure 2:
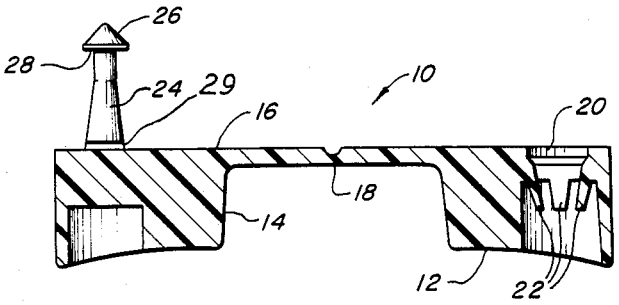
FIG. 2 is a view in section taken on line 2—2 of FIG. 1.
Figure 3:
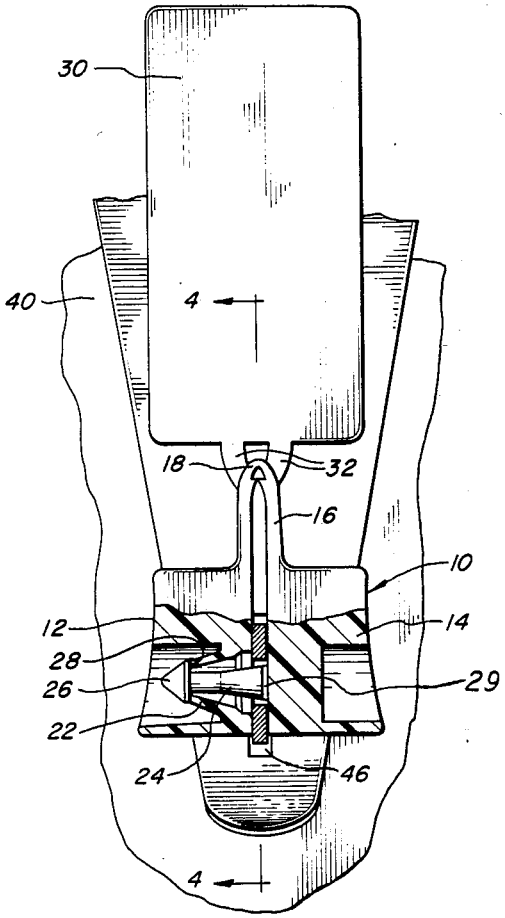
FIG. 3 is a front plan view, partly in section, of the seal assembled into sealing relationship with a container closure member.

As illustrated in FIGS. 1–3, the seal may be most conveniently molded with the flat strap portion, the bottoms of the fastener support bodies, and the tag 30 in one plane, with the stud 24 and the socket aperture being disposed perpendicular to said plane. This configuration allows the device to be injection molded in a mold having a minimum of camming portions and provides a structure which can be easily adapted for automated handling, to apply identifying marks or numbers to the tag 30.

The seal is designed for use in installations where previous seals were of the lead and wire type, in which the "staple" of the closure assembly is made of a piece of sheet metal, having a relatively small hole to receive the seal, and in which the distance from the hole receiving the seal to the front face of the hasp is relatively small, such as the herein illustrated telephone coin box.

Therefore the stud 24 and socket aperture 20 are spaced as close to the outer edge of the fastener support portions as is practical, so that the seal may be assembled in the manner shown in FIG. 5.

Although this is the most convenient manner in which to assemble the seal, when assembled in this position, the seal projects outwardly from the front surface of the coin box, and the tag is also spaced away from the surface of the box. Therefore the seal is shaped and dimensioned so that after the initial assembly as shown in FIG. 5, the seal may be rotated toward the container to the position of FIG. 6, so that the seal lies flat against the hasp of the container. The flexible members 32 allow the tag to rotate in relation to the seal body during this movement so that it too lies flat against the hasp.

To insure that the seal is maintained in this position thereafter, the fastener support bodies are provided with a generally rectangular cross-section, the dimension of which are such that during said movement from the position of assembly to the final position, the corner 34 of the fastener support portions resiliently engages the surface of the hasp, so that the hasp is flexed inwardly by the corners 34 as the seal moves to its final position as shown in FIG. 6. Therefore the seal is prevented from rotating back to its position of first assembly by the spring action of the hasp and the corners 34.

What is claimed is:

1. A security seal for assembly onto a staple to seal a hasp onto the staple, said seal being formed of a single piece of injection molded plastic and comprising a flexible strap, a fastener support body at each end of the strap, one of said bodies having an aperture in the upper surface leading to a set of resilient locking fingers, the other body having an upwardly projecting stud member positioned and dimensioned for locking engagement in said socket when the strap is folded at a medial portion to move said fastener support bodies together, said fastener support bodies each having a shape in cross-section perpendicular to the axis of the strap which provides a projecting portion which is positioned to extend radially from the axis of the engaged stud and socket generally at an angle of 45° to the longitudinal axis of the folded strap and away from said folded strap, said bodies and said projecting portions being so dimensioned in relation to a staple and hasp with which the seal is to be assembled that when the seal is assembled with the staple so that the fastener bodies are positioned on opposite sides of the staple and with the stud extending through the staple into engagement with the socket and then rotated about the axis of the assembled fasteners from an initial assembled position in which the folded strap projects outwardly from the surface of the hasp to a position in which it lies against the surface of the hasp, said projecting portions frictionally and resiliently engage the surface of the hasp during such rotation in a manner such that the seal can snap from the initial assembled position to the final assembled position, whereby said projecting portions resist rotation of the seal away from the final assembled position.

2. A security seal for assembly onto a staple of a staple and hasp assembly of predetermined dimensions in which the staple protrudes through a slot in the hasp, said seal comprising a pair of seal bodies connected by a flexible member, said body portions each having a fastener carrying face on corresponding sides so positioned that when the flexible member is bent to a U-shape, the faces are closely adjacent and facing each other and may be positioned on opposite sides of said staple, one of said body portions having an internal socket opening to the face thereof, the other body portion having a stud protruding from the face thereof, the stud and socket being so dimensioned and being so positioned as to enable the stud to extend through said staple into locking engagement with the socket with the faces of the body portions being spaced apart by substantially the thickness of the staple, said body portions having substantially flat end portions adjoining the faces and which are generally perpendicular thereto and are substantially co-planar when the stud and socket are engaged and are so positioned in relation to the axis of the assembled stud and socket that the plane of said ends is, when the seal is assembled with a staple and hasp of said predetermined dimensions, disposed closely adjacent to the hasp to maintain the seal in a predetermined orientation in relation to the hasp.

3. A seal as set out in claim 2 in which the flat ends are so dimensioned and positioned in relation to said hasp and staple with which it is to be assembled that after initial assembly with the staple with the flat ends bearing against the hasp, the seal may be rotated about the axis of the assembled stud and socket whereby the corner between the flat ends and an adjacent side of the body resiliently engages the front surface of the hasp during said rotation until the seal has been rotated substantially 90°.

4. A security seal as set out in claim 3 in which said seal has a tab connected to the flexible member, said tab initially extending from the flexible member in a direction so as to be parallel to the hasp and spaced therefrom when the seal is assembled with the staple with the flat ends facing the hasp and being connected thereto by flexible connecting means, whereby when the seal is assembled with the staple with the flat ends facing the hasp and rotated 90° about the axis of the assembled stud and socket, the tab lies flat against the outer surface of the hasp.

5. A seal assembly comprising a hasp, a staple protruding through a hasp aperture, and a seal assembled onto the protruding portion of the staple, said seal comprising two body portions disposed on opposite sides of the staple and locking means extending from one body portion into locking engagement with the other body portion, said body portions being connected by a flexible shackle, and means on the body portions resiliently maintaining said body portions in a predetermined orientation in relation to the surface of said hasp.

6. A seal assembly as set out in claim 5 in which said means retaining the body portions in said predetermined orientation comprises a projecting body portion positioned to resiliently engage the hasp as the body portions are rotated about the axis of the locking means.

7. A seal assembly comprising a container having a hasp with a slot, a staple protruding through the slot, said hasp being inclined slightly outwardly from the adjacent surface of the container and being resiliently movable inwardly, and a seal assembled into the protruding portion of the staple, said seal comprising a pair of body portions disposed on opposite sides of the staple and having locking means extending through the staple from one body portion into locking engagement with the other body portion, said body portions being connected by a flexible shackle, at least one body porton having a cross-sectional shape in a direction perpendicular to the hasp surface which provides a portion adjacent the hasp surface which is sufficiently far from the axis of the locking means that rotation of the seal around the fastener axis is effected only by engagement of said portion with the hasp surface to cause resilient movement of said hasp inwardly.

8. A security seal assembly, comprising a hasp, a staple arranged to protrude through the hasp, and a seal for assembly onto the staple, said seal comprising a flexible strap, a fastener support body at each end of the strap, one of the bodies having an aperture in a surface leading to a set of resilient fingers, the other body having a projecting stud positioned and dimensioned for extending through the staple into locking engagement in said socket when the strap is folded at a medial portion to move said fastener support bodies together, said fastener support bodies each having a shape in cross-section perpendicular to the axis of the stud which provides a corner on the end of each body, said bodies being so dimensioned in relation to the staple and hasp that when the seal is assembled with the fastener bodies positioned on opposite sides of the staple and with the stud extending through the staple into locking engagement with the socket and then rotated about the axis of the stud from an initial position in which the folded strap projects outwardly from the surface of the hasp to a position in which the strap lies against the surface of the hasp, one set of support body corners frictionally and resiliently engages the surface of the hasp during such rotation thereby allowing the seal to snap from the initial assembled position to a final assembled position, whereby the support body corners resist rotation of the seal away from the final assembled position.

* * * * *